United States Patent [19]

Shimizu et al.

[11] 4,282,503

[45] Aug. 4, 1981

[54] ELECTROMAGNETIC DEVICE

[75] Inventors: Masami Shimizu, Tokyo; Hiroshi Aizawa, Kawasaki, both of Japan

[73] Assignee: Canon Kabushiki Kaisha, Tokyo, Japan

[21] Appl. No.: 70,801

[22] Filed: Aug. 29, 1979

[30] Foreign Application Priority Data

Sep. 7, 1978 [JP] Japan ..... 53-109980

[51] Int. Cl.[3] ..... H01F 7/08

[52] U.S. Cl. ..... 335/276; 335/229; 335/279

[58] Field of Search ..... 335/270, 229, 274, 230, 335/275, 276, 279, 281

[56] References Cited

U.S. PATENT DOCUMENTS

| | | | |
|---|---|---|---|
| 2,436,354 | 2/1948 | Burke et al. | 335/270 X |
| 3,511,285 | 5/1970 | Stephens | 335/276 X |
| 3,652,965 | 3/1972 | Krebs et al. | 335/270 X |
| 3,705,370 | 12/1972 | Chai et al. | 335/276 X |

*Primary Examiner*—George Harris

*Attorney, Agent, or Firm*—Toren, McGeady and Stanger

[57] ABSTRACT

An electromagnetic device comprising a fixed yoke and a rotatable armature is disclosed. The yoke and armature of the device are mounted on a common shaft, and also the lower surface of the yoke and the upper surface of the armature slidingly contact with each other.

4 Claims, 6 Drawing Figures

ELECTROMAGNETIC DEVICE

BACKGROUND OF THE INVENTION

1. Field of the Invention

The present invention relates to an electromagnetic device and, more particularly, to an electromagnetic device suited for use in a camera.

2. Description of the Prior Art

In general, a conventional electromagnetic device is constructed as shown in FIG. 1, that is, from a ground plate 1, a yoke 2 fixedly mounted thereon, and coils 4 wound on the yoke 2 through bobbins 3, with these coils 4 being connected through the ends 2*a* to an electromagnet control circuit (not shown). In a portion of the magnetic path of the above-described yoke 2, there is provided a permanent magnet 2*b* for attraction, arranged, for example, as shown in FIG. 2. The device further includes an armature 5 arranged to be normally attracted to the yoke 2 by magnetic force and upon energization of the coils 4 to be moved away from the yoke 2 by the biasing force of a spring 7 on an armature lever 6.

In such a electromagnetic device, it is desired that the adhesion stability between the yoke 2 and armature 5 be excellent. Particularly in application to photographic cameras and the like, an electromagnetic device which lacks sufficient adhesion stability leads to faulty operation, finally resulting in improper exposures. For this reason, there has been an improved demand for such adhesion stability.

To achieve this improvement, the confronting end surfaces of the yoke 2 and armature 5 must be made precisely parallel to each other, in other words, the armature shaft 8 must be made exactly normal to the armature 5. To establish this normal arrangement of the armature shaft 8 to the armature 5, the armature shaft 8 is brought into normal relationship to the armature lever 6, and then the armature 5 has to be placed perpendicular to this shaft. To do so, however, there is some difficulty with respect to machining accuracy. Accordingly, it follows that in practice, the armature shaft 8 tends to be set with some inclination to the armature plane 5. Therefore, it is very difficult to obtain the desired precisely parallel arrangement between the confronting end surfaces of the yoke 2 and armature 5, that is, to assure good stability of adhesion.

If the end surface of the yoke 2 is not parallel to that of the armature 5, when the armature 5 is brought into adhesion with the yoke 2 by the magnetic force, the armature 5 will adhere to the yoke 2 in an inclined position where the adhesion is not sufficiently stabilized. Alternatively, when the armature 5 is moved away from the yoke 2 under the action of the spring 7, a force inclined to the direction in which the armature 5 moves is also applied to the armature so that even a smaller force is able to break the adhesion of the armature 5 to the yoke 2. Therefore, sufficient adhesion is not provided. Thus, since the actuation for movement of the armature can be effected by a weak force, any shock, however small, when applied to the electromagnetic device from outside, will cause accidental separation of the armature 5 from the yoke 2. Accordingly, the use of such electromagnetic device in a camera gives rise to faulty operation which, in turn, will very likely cause improper exposures.

According to the prior art, the above-described drawback of the conventional electromagnetic device, i.e., the problem of improving the adhesion stability, has been overcome by employing such an arrangement of the armature 5 and the armature lever 6 as shown in FIG. 3. That is, the armature shaft 8 is provided with a projected portion 8*a* in the form of a ring of semi circular cross-section around the central peripheral portion thereof and a flanged portion 8*d*, and is fixedly mounted on the armature lever 6 at one end 8*b* thereof. The armature 5 is rotatably and tiltably fitted at a penetration hole 5*a* thereof on the projected portion 8*a*, and is restrained from outward axial movement by an E shaped ring 10 engaging in a circumferentially grooved position 8*c* near the other end thereof. By such construction, the possibility that the armature 5 and the yoke 2 will not be parallel can be reduced so that the armature 5 adheres to the yoke 2 without causing excessive inclination. Thus, the degree of stability of adhesion is increased. Also, when the armature 5 is moved away from the yoke 2, a twist-like motion can be eliminated so that the armature is protected even to external shocks, and accidental separation of the armature 5 is not easily effected.

However, even in such conventional type of electromagnetic devices, there was failure in establishing parallelism between two separate areas of the active surface of the yoke, there was insufficient stability of adhesion, and the device was not sufficiently stabilized to external shocks. Further, since the ring-like projection 8*a* of the armature shaft 8 contacts with the inner surface of the break-through hole 5*a* in a line, frequent repetition of actuation, that is, attraction and release, results in a large amount of abrasion at the contact areas. Accordingly, the adhesion stability tends to deteriorate and the resistance to external shock also tends to be weakened.

Another disadvantage in this prior construction is that, because of the provision of a leaf spring 11 between the armature 5 and a bent-off portion of the armature lever 6 to increase the stability of adhesion, when the armature is removed from contact with the yoke 2, vibrations about the armature shaft 8 by the leaf spring 11 are imparted to the armature 5. If this operation is repeated at a high frequency as in motor driven photography, the next charging operation is initiated before the vibrations have been damped to a sufficiently low level, thereby the confronting end surfaces of the armature 5 and yoke 2 are damaged to effect a substantial reduction in adhesion force. This constitutes another problem concerning the durability of the device.

SUMMARY OF THE INVENTION

An object of the present invention is to provide an electromagnetic device which has overcome the above-mentioned drawbacks of the conventional device.

Another object of the present invention is to provide an electromagnetic device whose adhesion stability is not lost even when in use for a long time.

For a better understanding of the present invention, reference is made to the following description and accompanying drawings, while the scope of the present invention will be pointed out in the appended claims.

DESCRIPTION OF THE PREFERRED EMBODIMENTS

Figure 1:
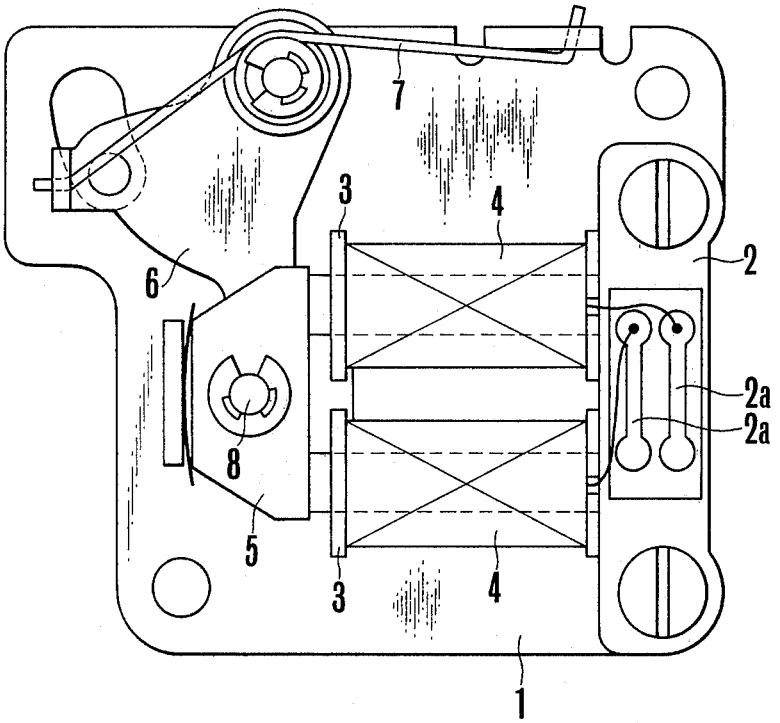
FIG. 1 (PRIOR ART)
FIG. 1 is a plan view of a conventional electromagnetic device.
Figure 2:
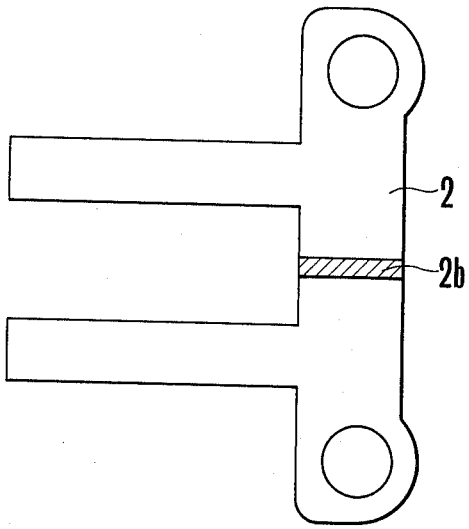
FIG.2 (PRIOR ART)
FIG. 2 is a plan view of the yoke of FIG. 1.
Figure 3:
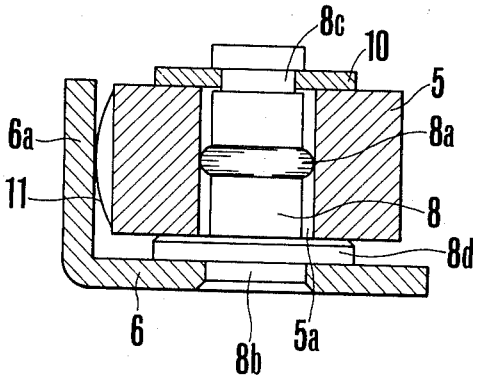
FIG.3 (PRIOR ART)
FIG. 3 is a sectional view of another conventional electromagnetic device taken along the armature shaft.
Figure 4:
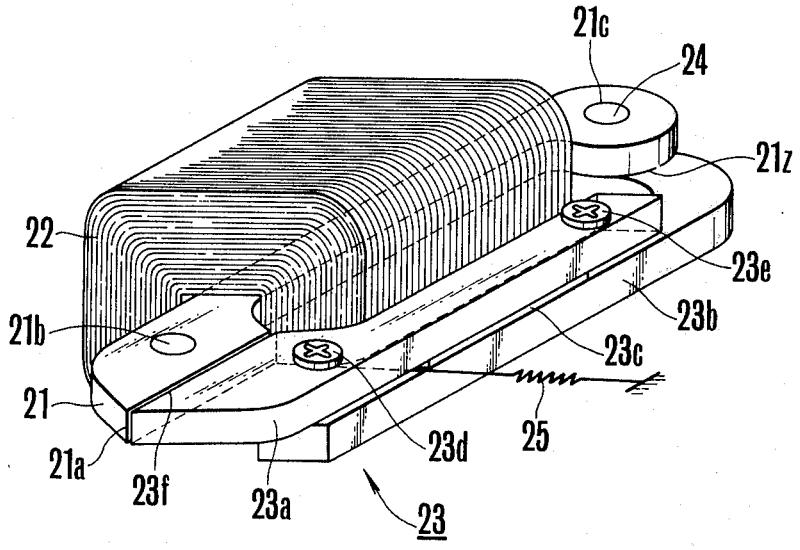
FIG. 4 is a perspective view of one embodiment of an electromagnetic device according to the present invention.
Figure 5:
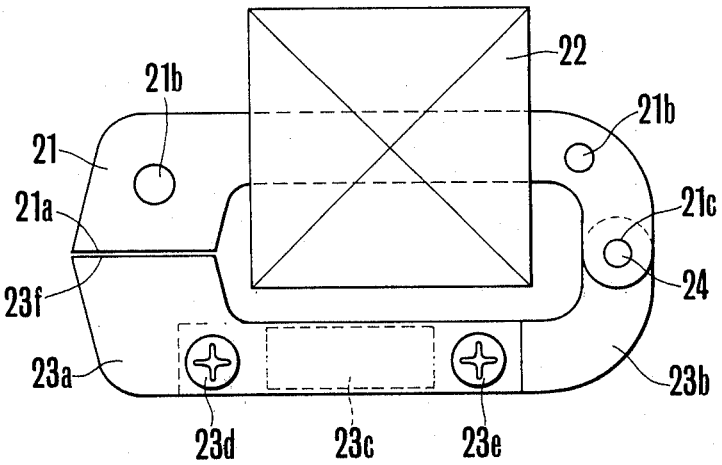
FIG. 5 is a top plan view of the device of FIG. 4.
Figure 6:
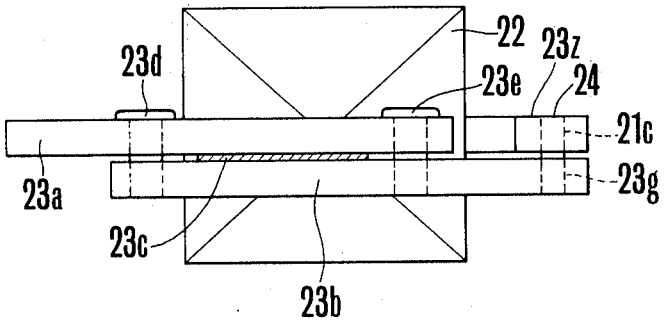
FIG. 6 is a side elevational view of the device of FIG. 4.

Referring initially to FIG. 4, there is shown an electromagnetic device of the release type employing one form of the present invention. Element 21 is a yoke fixedly mounted on a shaft 24 which serves as the rotation shaft for the armature. The yoke 21 has a ramp portion formed at one end thereof being provided with a confronting adhesion surface 21*a* with the armature and a hole 21*b* by means of which the device is fixedly secured to, for example, the camera housing. Yoke 21 also has a hole 21*c* at the other end for the purpose of fixedly mounting the yoke body on the rotation shaft 24. Element 22 is a coil turned around the yoke 21 which, upon supply of current, generates a magnetic flux to release the armature from the adhesion to the yoke. The terminal ends (not shown) of said coil 22 are connected to an energization control circuit (not shown). Element 23 is an armature rotatably mounted on the shaft 24. Armature 23 has two members 23*a* and 23*b* fixed to each other by screws 23*d* and 23*e* as shown in FIG. 6. The one member 23*a* of the above-described armature 23 has its ramp portion provided with an adhesion surface 23*f* in a position opposite to the adhesion surface 21*a* of the above-described yoke 21 and with a penetration hole for the above-described screw 23*d*, and has a penetration hole for the above-described screw 23*e* near the other end. The other member 23*b* of the above-described armature 23 has, as shown in FIG. 6, two penetration holes for the screws 23*d* and 23*e* and a hole 23*g* (FIG. 6) for freely fitting the armature 23 on the rotation shaft 24. Element 23*c* is a permanent magnet inserted, as shown in FIG. 6, in between the two members 23*a* and 23*b* constituting the armature 23, its longitudinal length being almost equal to the width of the armature 23 as shown in FIG. 5. Element 25 is a spring connected at one end thereof to the screw 23*d* to urge the armature 23 for counter-clockwise movement.

Next, for a better understanding of the present invention, the process for producing an electromagnetic device of the above-described construction will be outlined with reference to FIGS. 4 to 6. At first, a yoke 21 having an external appearance, as shown in FIG. 5, is made up by press or the like, and its blank is then treated to make up a fastening hole 21*b* and a penetration hole 21*c* for fixedly mounting the yoke 21 on the rotation shaft 24. At this time, the diameter of the hole 21*c* is adjusted so that the rotation shaft 24 fits sufficiently freely therein. Next, the adhesion surface 21*a* is polished with respect to this hole 21*c*. Then, a coil having a necessary number of turns is wound thereon. In a fashion similar to that of the yoke 21, blanks 23*a* and 23*b* for the armature 23 are shaped by press or the like. It is noted here that the size of the hole 23*g* is limited within an allowable fit tolerance so that the armature 23 is pivoted at the shaft 24 without being loose.

After that, a permanent magnet 23*c* is sandwiched by the armature forming members 23*a* and 23*b* as is shown in FIG. 6, and then fixed in a predetermined position by the screws 23*d* and 23*e*. It is, of course, necessary that before the members 23*a* and 23*b* are fastened by the screws 23*d* and 23*e*, a spring 25 is hooked to the screw 23*d*. Then, the adhesion surface 23*f* is polished with respect to the hole 23*g*. Then, across both ends of the armature 23 is applied a magnetic field to magnetize the member 23*c* for the permanent magnet. After the magnetization of the member 23*c* has been completed, the yoke 21 and the armature 23 are brought into contact with each other at their confronting adhesion surfaces 21*a* and 23*f*, as shown in FIG. 5, and are maintained in this condition under the action of attraction force of the permanent magnet member 23*c*. Then, while this adhesion state is maintained, the shaft 24 is inserted through the holes 21*c* and 23*g*, and then fixedly secured to the hole 21*c* by an adhesive agent or the like. Thus, the electromagnetic device is finished. When this electromagnetic device is used in a camera, for example, the fastening hole 21*b* provided in the yoke 21 is utilized in attaching this device to the camera at a predetermined position.

It will be appreciated from the foregoing that according to the present invention, sufficient adhesion stability can be assured with ease even when the rotation shaft for the armature is not inserted normal to the armature and the armature is inclined to make some improper angles with the armature plane, for the shaft on which the yoke is mounted is common with the shaft of the armature, and further the lower surface 21*z* of the yoke contacts with the upper surface 23*z* of the armature. This ensures that the adhesion surfaces of the yoke and armature can always be set in parallel with each other, unlike the conventional device. Further, since there are substantially no parts susceptible to deformation resulting from being worn-out or damaged in use, the adhesion stability remains at a sufficient operating level for a long time. The resistance, that is, the stability of the armature in the attracted position against shocks, is greatly improved since it depends on the machining accuracy of substantially only one pair of contact surfaces.

While the foregoing description and drawings represent the preferred embodiments of the present invention, it will be obvious to those skilled in the art that various modifications may be made therein without departing from the true spirit and scope of the present invention.

What is claimed is:

1. An electromagnetic device comprising:

(a) a support shaft;

(b) a yoke havig an adhesion surface and fixedly mounted on said support shaft; and (c) an armature consisting of a straight-extending first member having an upper surface in contact with the lower surface of said yoke and rotatably mounted on said support shaft and a straight-extending second member, fixedly mounted on said first member, which can be detached from the first member and having an adhesion surface provided at the free end thereof in a position opposite to said adhesion surface.

2. An electromagnetic device according to claim 1, further including:

(a) a permanent magnet attached to said armature to hold the adhesion surface of said yoke and the adhesion surface of said armature in a predetermined position; and (b) a coil wound on said yoke to produce a magnetic flux which cancels the magnetic flux of said permanent magnet.

3. An electromagnetic device according to claim 1, further including a permanent magnet inserted in-between the two members constituting an armature to form a release type electromagnetic device.

4. An electromagnetic device comprising:

(a) a support shaft;

(b) a yoke having an adhesion surface and fixedly mounted on said support shaft; and (c) an armature consisting of a straight-extending first member having a surface in contact with the surface of said yoke and rotatably mounted on said support shaft and a straight-extending second member, fixedly mounted on said first member, which can be detached from the first member and having an adhesion surface provided at the free end thereof in a position opposite to said adhesion surface of said yoke.

* * * * *